United States Patent [19]

Florczyk et al.

[11] 4,434,906

[45] Mar. 6, 1984

[54] CONTAINER HAVING RESEALABLE OPENING MEANS

[76] Inventors: Rolf Florczyk, Pfingstmannstrasse 18, D-4350 Recklinghausen; Reinhold Krischik, Cranger Strasse 200, D4660 Gelsenkirchen-Buer, both of Fed. Rep. of Germany

[21] Appl. No.: 436,961

[22] Filed: Oct. 27, 1982

[30] Foreign Application Priority Data

Oct. 29, 1981 [DE] Fed. Rep. of Germany ..... 3142837

[51] Int. Cl.[3] ..... B65D 17/32

[52] U.S. Cl. ..... 220/268; 220/345; 220/336

[58] Field of Search ..... 220/267, 268, 345, 346, 220/336

[56] References Cited

U.S. PATENT DOCUMENTS

| | | | |
|---|---|---|---|
| 4,003,493 | 1/1977 | Wells et al. | 220/268 |
| 4,023,703 | 5/1977 | Strole et al. | 220/268 |
| 4,132,328 | 1/1979 | Zundel | 220/268 |

*Primary Examiner*—George T. Hall

*Attorney, Agent, or Firm*—Michael J. Striker

[57] ABSTRACT

In a sheet metal or plastic container for storing beverages or the like a plug member is located against an opening region provided in the container's end wall and defined by a score line. The plug member has a closing peripheral edge which has the same geometry as the peripheral edge of the opening resulted after the score line is ruptured by external pressure applied to the plug member towards the interior of the container. The plug member and the opening region after it has been ruptured are slidably displaced from the opening to expose the latter. That opening can be tightly closed again by the plug member inserted at that peripheral edge into the opening.

22 Claims, 11 Drawing Figures

Fig.10
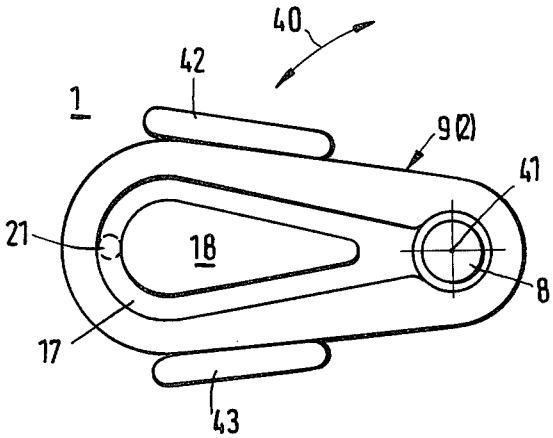
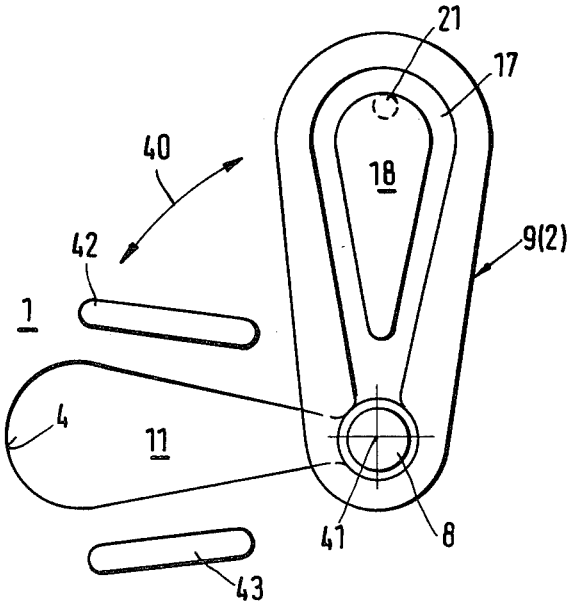
Fig.11

CONTAINER HAVING RESEALABLE OPENING MEANS

BACKGROUND OF THE INVENTION

The present invention pertains to containers in general, and particularly to containers for storing drinks or beverages. More particularly, the invention relates to a container wall structure provided with an operating element for opening the container by pushing in that operating element into the interior of the container.

Containers provided with operating elements to which external force, for example by a user's finger, is applied to release an opening through which a fluid stored in the container is poured out, are known in the art. In some of the known containers a separable or releasable opening region is provided in the container wall, which region is connected to the remaining portion of the container wall by a breaking edge extended along a score line. That breaking edge can be ruptured loose along said line by the external force applied to the operating element overlapping that opening region and pushed into the container whereby an opening is formed in the container wall; the operating element can be then slidably displaced relatively to the opening.

One of such containers is disclosed, for example, in U.S. Pat. No. 4,023,703 (FIGS. 48–53). In the disclosed container the circular opening region is located below the operating member having a semicircular end portion which merges into the hyperbolic portion and the parabolic portion. Force applied to the operating member for rupture of the opening region is transmitted to three separate locations, namely at the point of contact between the recess 276 and the downwardly-dished area 271, at the rivet connection and at the point where the score break dimple 278 contacts the operating member. It is important, however, to provide punctual force transmission from the operating member to the opening region of the container wall. Since containers under consideration are normally made out of sheet elastic metal punctual force transmission should be ensured so that the score line will be broken loose along its entire length.

If only partial rupture takes place it is necessary to use some auxiliary implements to break loose the remaining unbroken part of the score line because this is impossible to do by hand due to the fact that the line is concealed below the operating member which overlaps the opening region. Rupture of the opening region can be also obtained by an opening tab often provided on the operating member. In this case the opening region must be taken off from the container wall; this, however can cause injury of the user's finger. In a container described in the German patent publication DE-OS No. 23 41 077 the opening region of the wall remains in the container after rupture of the score line. This is also undersired, because it can lead to a waste product.

The disadvantage of the container disclosed in the both publications is that the opening formed in the container wall after rupture of the score line is not protected against the penetration of dirt, dust particles and insects into the container. Furthermore, if a container is dumped or put upside down the container's content flows out through that opening.

And finally, the score line, particularly in the structure shown on the U.S. Pat. No. 4,023,703 due to punctual force transmission can be ruptured by a relatively small pressure force applied onto the shearing projection; this can happen because the overlapping border of the operating member located against the opening region is not easily recognizable by a user, and, on the other hand, if coal acid-containing drinks are stored in the container the effect of coal acids escaping the container through the small break in the wall can make the container unsuitable for food storing.

In U.S. Pat. No. 4,023,703 (FIGS. 22–27) a tab is formed as a fully removable button provided with press-type connection means, snap-type connection means or threaded-type correction means. The disadvantage of this structure is that the button can not be tightly held in the container wall.

In the embodiment illustrated in FIGS. 48–53 of the U.S. patent under consideration tight reclosure of the exposed opening with the tab member is impossible because no controllable sealing is suggested in the reference and because two different ruptured opening regions must be taken into consideration.

U.S. Pat. No. 3,236,409 suggests another container wall construction in which a sheet metal plug has a metal tab fixed to the outside thereof. The disclosed structure also does not seem to be satisfactory because a plug totally separated from the opening stamped out from the container wall must be reinserted into that opening. If a container is formed of metal and coal-acid containing drinks are stored in that container such a structure has a drawback resided in that the cut edges of the opening are not protected against corrossive liquids. This lack of protection against corrosion leads to that the cut edges of the openings will be corroded in a very short period of time. The container's content poured out of the container and contacting those edges will be thus deteriorated.

The purpose of continuous connection of the opening region with the remaining portion of the container wall along the score line is that a continuous protective layer on the inner side of the container is ensured. Such a container, particularly its end or cover wall which is connected to the opening region by the score line has been subject of complex tests involving stress-measuring methods to determine whether the thickness of the protective layer was sufficient in all points of the score line. In the case if the cut edges the opening stamped out from the container wall are not coated with a new protection layer the tests performed proved that a container did not meet the standards and was found unsatisfactory.

Another conventional structure of the container has been disclosed in the European patent application 33,449. In that structure the openable closure member includes an opening tab provided on the container's cover, which tab can be inserted into the opening stamped out from the wall by rupturing the latter. This container is unsuitable for storing corrossive liquids either. In this container an additional score line is provided in the vicinity of the peripheral edge of the opening. In that case force transmission of external force applied via the closure member to the opening region is also different from that suggested in the present application.

The present invention has been designed to overcome disadvantages of conventional easy-openable containers of the type under consideration.

SUMMARY OF THE INVENTION

It is an object of the invention to provide an improved container for storing drinks and beverages.

It is a further object of the invention to provide a container with an end wall structure in which the breaking line of the opening region can be broken loose without danger of injuring user's fingers.

It is still another object of the invention to provide a container in which the breaking line can be broken by an external force applied towards the interior of the container along the entire periphery of the breaking line and wherein an opening originated by that breaking can be fluid-tight closed by a force-locking or form-locking connection.

These and other objects of the invention are attained by a wall structure for a container, comprising a container wall, an opening region in said wall surrounded by a break edge defined by a score line and connecting the opening region to a remaining portion of the wall, said opening region can be ruptured along said score line and separated from said remaining portion by external pressure applied toward an interior of the container to form in said wall an opening defined by said break edge; and an operating member connected to said opening region and located above said opening region so as to overlap said break edge, said opening region after being ruptured remaining in the interior of the container and being slidably displaced by said operating member relative to said opening, said operating member being a plug member formed with a peripheral closing edge region adapted to fluid-tightly close said opening when displaced to be positioned against said opening, said edge region having a configuration similar to the configuration of said break edge and that of said opening, said closing edge region including a form-and force-locking closing edge having a configuration similar to that of said breaking edge and extending parallel to said score line, and a pressure edge directed towards said opening region.

Due to the above described structure a user can, with only one thumb push in the plug element and with only one operation step and without any danger of finger injury, totally rupture the score line, release the opening in the container wall and then again tightly close that opening if desired.

It is particularly advantageous in the container of the present invention that the break edge of said opening and said closing edge region of the plug member have each a continuously curved shape, said closing edge region being conically tapered in the direction of said opening. In such an arrangement the force- and form-locking connection of the clamped plug inserted into the opening is ensured along the entire periphery of the score line.

For increasing stability and rigidity of the plug member the latter may be formed with a peripheral bead extended substantially parallel to said break edge and projected in the direction toward said opening, said bead having a bottom defining said pressure edge and an outer wall defining said closing edge.

In accordance with a further feature of the invention the opening in the container wall may have two opposite straight edges; the structure may further comprise opposite guide beads formed on said container wall and curved outwardly therefrom, said guide beads extending parallel to said straight edges such that said closing edge region of the plug member is slidably displaced along said guide beads.

The peripheral closing edge region of the plug member may be coated with a sealing layer of elastic material. This material may be synthetic plastic or rubber.

According to a still further feature of the invention the plug member may be made out of impact-resistant and bending-resistant synthetic plastic material, which may be polysterene, polyamide, or polyolefin or any other suitable material.

The plug element may be rigidly connected to said opening region and may be pivotally displaced together with said opening region to expose said opening.

In accordance with another feature of the invention the opening region may have a first end portion at which said opening region is connected to said plug member and an opposite second end portion, said second end portion being formed with a projection which engages the container wall by a friction-force connection and/or in a resilient mode after said plug member and said opening region have been slidably displaced relative to said opening. Due to this arrangement undesired closing of the exposed opening during drinking is precluded as well as potential finger injury which can be caused during dumping of the container.

The opening in the container wall may have two opposite rounded end surfaces respectively merging into said straight edges.

The wall opening and the closing edge of the plug member each may have a wedge-like configuration or, alternatively an oval configuration.

According to still further feature of the invention the container wall may have an outer face which is formed with at least one projection at which said pressure edge of the plug element is arrested when the latter is at least partially slidably displaced relative to said opening.

The plug member may be made out of metal and provided at its periphery with a reinforcing fold.

The plug element may be connected to said opening region by a rivet.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 10 illustrates a plug element similar to that of FIG. 6 but with a pivotable connection, and in its closed position; and FIG. 11 illustrates the plug element of FIG. 10 but in its released position.

DETAILED DESCRIPTION OF THE PREFERRED EMBODIMENTS

Figure 1:
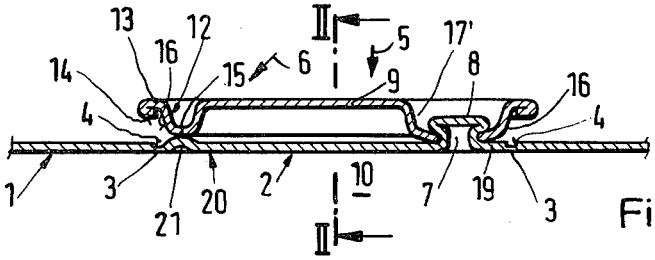
FIG. 1 is a longitudinal sectional view of the wall structure of the container with a plug element according to the invention.
Figure 2:
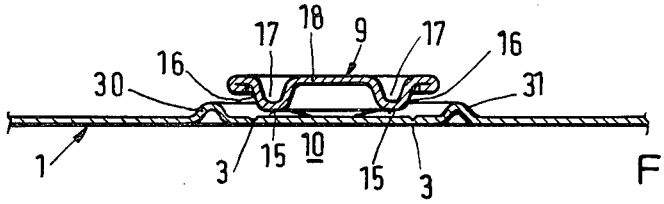
FIG. 2 is a sectional view along line 11—11 of FIG. 2.
Figure 3:
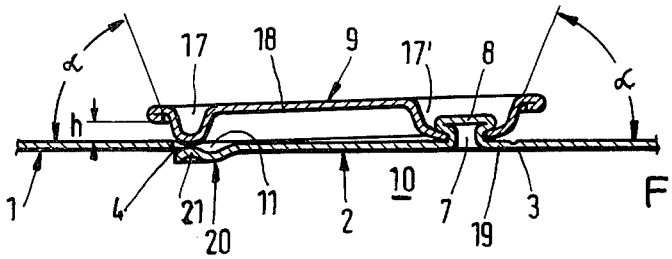
FIG. 3 is a view similar to that of FIG. 1 but in a position of rupturing an opening region in the wall.
Figure 4:
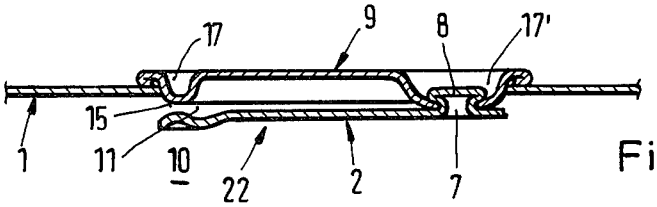
FIG. 4 is a view similar to that of FIG. 1 but in a position when rupture of the opening region has been completed and the plug element has been tightly inserted into an opening formed by that rupture.
Figure 5:
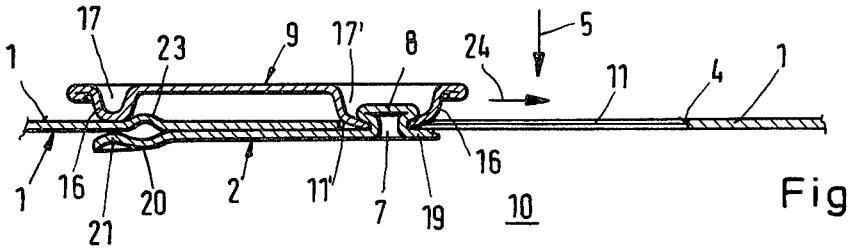
FIG. 5 is a view similar to that of FIG. 4 but in a position after lifting the plug element out from the opening and its complete releasing by slidable displacing towards the left half of the container wall.

Referring now to the drawings, and first to FIGS. 1–7 it will be seen that a container wall structure includes a container wall 1 which is provided with a separable opening region 2 defined by a score line denoted at 3 along which is extended an edge 4 of a future opening 11 to be formed by pushing in a plug element 9 towards the interior 10 of the container as shown by arrows 5 and 6 and rupturing that score line. The opening region 2 of the container wall 1 is connected to the plug element 9, which is here an operation member, by means of a hollow rivet 7 whose head 8 is deformed on and thus rigidly secured to the plug element 9. The opening region 2 of the container wall is slidably displaced by the plug element relative to the opening 11 after the latter was formed by rupturing the edge 4 (as seen in FIG. 5).

The plug element 9 is provided with a substantially rounded peripheral closing edge region 12 which in the present embodiment has a cross-section of a Z-shape. The plug element 9 may be made out of metal. Its closing edge region 12 has at its upper web 13 a rounded reinforcing fold 14 which can be formed as a reinforcing rib. As an alternative, the plug element 9 can be formed of synthetic plastic material such as polysterene, polyamide, polyolefin or the like.

The lower Z-shaped pressing webs 15 of the closing edge region 12 of the plug element 9 (FIG. 2) form a substantially circular pressing edge of the plug element, which is directed towards the opening region 2 of the container wall.

The area of the closing edge region 12 formed between the upper web 13 and lower webs 15 forms an actual closing edge 16 of the plug element 9. This closing edge 16 which extends along the whole height h (FIG. 3) between the Z-shaped web 13 and the pressing edge formed by webs 15 can, in the present case of the horizontal container wall 1, be concavely or convexly curved; for example as seen in FIG. 3 the closing edge 16 is inclined at angle $\alpha$ to horizontal wall 1 so that the entire plug element 9 has at this closing edge 16 a conical shape.

Plug element 9 further has a central part 18 defined by a circumferentially extended stiffening bead 17. An enlarged bead portion 17' (FIGS. 1 and 6) is provided in the plug element 9 in the area of rivet head 8 to accommodate the latter. Outer walls 13, 14, 16, 15 of the bead 17 form the aforementioned closing edge region 12.

As seen from FIGS. 1, 3–7, rivet 7 is located in a border zone 19 of the opening region 2. A border zone 20 opposite to zone 19 is provided with a formation or projection 21 which, after rupturing the breaking edge 4 and displacing opening region 2 of container wall 1 to the left as seen in FIG. 5, engages the container wall 1 in a friction-force-connection mode and/or in a resilient mode.

It is advantageous that the plug element 9 forms, after rupturing the edge 4, a substantially U-shaped clamping spring 22 out of the opening region 2 connected to plug element 9 by rivet 7; this can be observed from FIG. 4.

As can be recognized from FIG. 5, at least one projection 23 is formed on the container wall 1 at its outer face 1', this projection serving the purpose of arresting the circular pressing edge formed by webs 15 of the plug element in its fully or partially released position. In this manner the plug element 9 jointly with the opening region 2 is held by force-locking and/or form-locking connection in that position. The projection 23 if possible is located such that a small portion 11' of the whole opening 11 remains under plug element 9; that portion is air permeable and serves as an air vent opening; this also facilitates pouring or drinking process through the relatively large opening 11.

Thereafter the plug element 9 can together with the opening region 2 be displaced to its closing position (as shown by arrow 24) and plug element 9 can be then pushed in the direction of arrow 5 whereby the rounded oblong closing edge 16 of plug element 9 will be sealed in the breaking edge 4 of the opening 11. This tight or sealed position can be obtained, on the one hand, by means of elastic deformation of the border area or surface in the vicinity of the breaking edge 4, or also by means of a thin layer of entropy-elastic material sprayed on the surface of the closing edge 16. The above layer may be formed of rubber or any other suitable synthetic plastic material.

Similar structural elements illustrated in FIGS. 6–11 have the same reference numerals as those of FIGS. 1–5.

Figure 6:
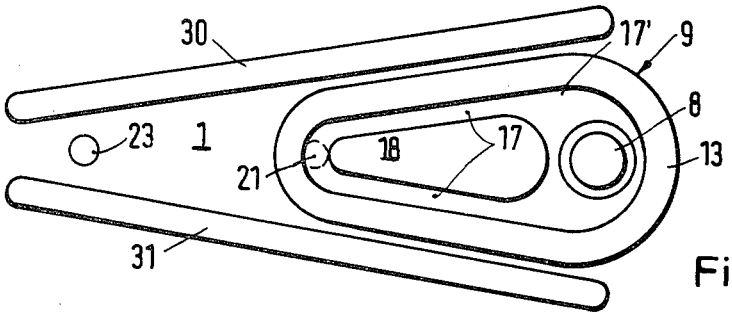
FIG. 6 is a partial top plan view of FIGS. 1 and 4.
Figure 7:
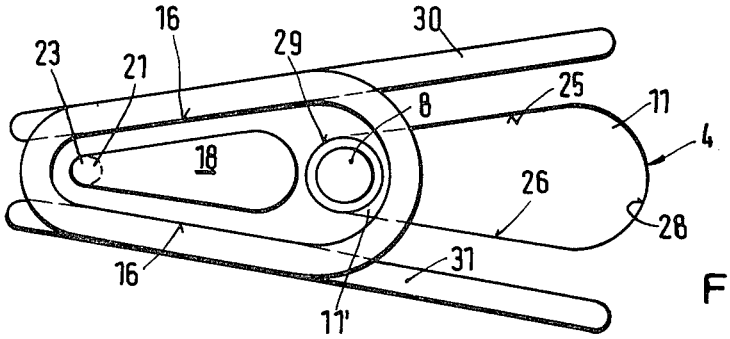
FIG. 7 is a partial top plan view of FIG. 5.

As seen from FIGS. 6 and 7 breaking edge 4 is constituted by two opposite side surfaces 25, 26, which taper to each other to form a wedge-like configuration, and two opposite rounded end surfaces 28, 29. Parallel to the side surfaces 25 and 26 are extended guide beads 30, 31 (also seen in FIG. 2) formed on the container wall 1 along the closing edge 16 of the plug element 9, these guide beads, which are convexly curved and extended outwardly of wall 1, guide the plug element 9 during its slidable displacement. The configuration of closing edge 16 in a plan view substantially corresponds to the configuration of the separable opening region 2.

Figure 8:
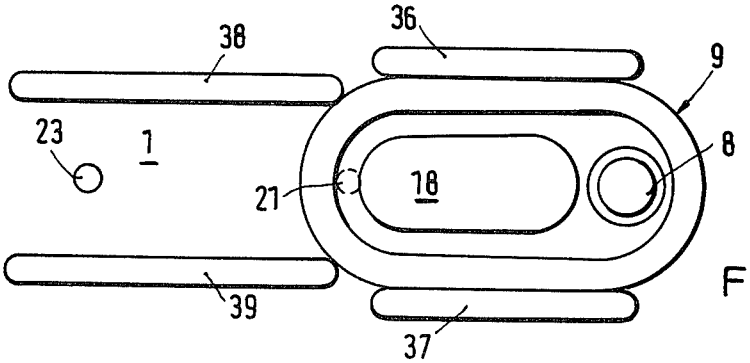
FIGS. 8 and 9 are top plan views corresponding to those of FIGS. 6 and 7 but illustrating a modified construction of the plug element and a respective opening region.
Figure 9:
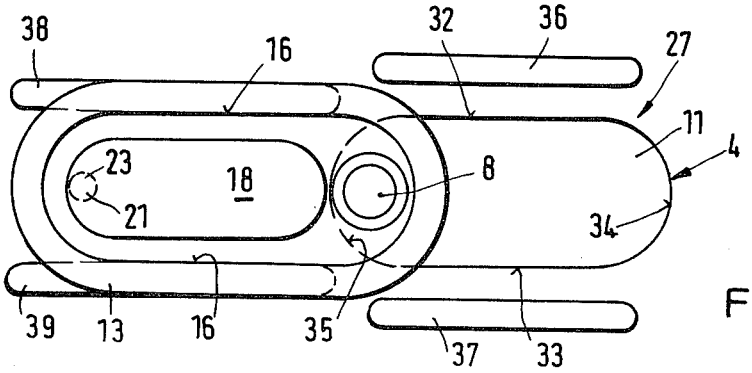

In the embodiment shown in FIGS. 8 and 9, the breaking edge 4 of opening 11 has an oval shape with two parallel side surfaces 32 and 33 and two semicircular end surfaces 34, 35. The closing edge 16 of the plug member 9 has in this case also an oval shape. Two pairs of outwardly extended guide beads 36, 37 and 38, 39 of convex cross-section shape are formed in the container wall 1 for guiding the plug element 9 in its displacement movement. As can be observed from FIG. 9 the closing edge 16 is slidably guided on the guide beads 38, 39; guide beads 36, 37 are spaced from each other a distance larger than that between the beads 38, 39; guide beads 36, 37 guide the outer edge of the Z-shaped web 13 or the reinforcing fold 14 because in this position the plug element 9 must be inserted into opening 11 by pushing it in the direction of arrow 5.

Reference is now made to FIGS. 10 and 11 which depict a modified embodiment of the invention. In this embodiment plug element 9 jointly with the opening region 2 connected thereto by rivet 7 is not slidably displaced as in the case of FIGS. 1–9 but is pivotable in directions of arrows 40 about a longitudinal axis of symmetry drawn through the rivet 7 which axis is a pivot point about which the plug element 9 and opening region are pivoted. In this structure convexly or concavely-shaped beads 42, 43 are formed on the container wall 1 which are arresting beads.

The specific advantage of the proposed container wall structure is, on the one hand, that it ensures that the opening region 2 can be ruptured at each point of the score line 3 for releasing the breaking edge 4 when a punctually acting force is applied to the plug element 9, for example by the thumb of a user. On the other hand, the proposed container wall structure provides that the score line 3 can be so strong that when external force is applied onto the whole surface, for example surface 18, of the plug element 9 inadvertently an accidental and undesired rupturing of the opening region 2 is prevented due to uniform force distribution required for its breaking.

It will be understood that each of the elements described above, or two or more together, may also find a useful application in other types of containers differing from the types described above.

While the invention has been illustrated and described as embodied in a container, it is not intended to be limited to the details shown, since various modivications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A wall structure for a container, comprising a container wall, an opening region in said wall surrounded by a break edge defined by a score line and connecting the opening region to a remaining portion of the wall, said opening region can be ruptured along said score line and separated from said remaining portion by external pressure applied toward an interior of the container to form in said wall an opening defined by said break edge; and an operating member connected to said opening region and located above said opening region so as to overlap said break edge, said opening region after being ruptured remaining in the interior of the container and being slidably displaced by said operating member relative to said opening, said operating member being a plug member formed with a peripheral closing edge region adapted to fluid-tightly close said opening when displaced to be positioned against said opening, said edge region having a configuration similar to the configuration of said break edge and that of said opening, said closing edge region including a form-and force-locking closing edge having a configuration similar to that of said breaking edge and extending parallel to said score line, and a pressure edge directed towards said opening region.

2. The structure as defined in claim 1, wherein said break edge of said opening and said closing edge region of the plug member have each a continuously curved shape, said closing edge region being conically tapered in the direction of said opening.

3. The structure, as defined in claim 2, wherein said plug member is formed with a peripheral bead extended substantially parallel to said break edge and projected in the direction toward said opening, said bead having a bottom defining said pressure edge and an outer wall defining said closing edge.

4. The structure as defined in claim 3, wherein said plug member simultaneously with rupturing of said score line is pushed by said pressure into the interior of the container along said score line.

5. The structure as defined in claim 4, said opening having two opposite straight edges, the structure further comprising opposite guide beads formed on said container wall and curved outwardly therefrom, said guide beads extending parallel to said straight edges such that said closing edge region of the plug member is slidably displaced along said guide beads.

6. The structure as defined in claim 5, wherein said peripheral closing edge region of the plug member is coated with a sealing layer of elastic material.

7. The structure as defined in claim 6, wherein said material is synthetic plastic.

8. The structure as defined in claim 6, wherein said material is rubber.

9. The structure as defined in claim 1, wherein said plug member is made out of impact-resistant and bending-resistant synthetic plastic material.

10. The structure as defined in claim 9, wherein said plug member is formed of polysterene.

11. The structure as defined in claim 9, wherein said plug member is formed of polyamide.

12. The structure as defined in claim 9, wherein said plug member is formed of polyolefin.

13. The structure as defined in claim 1, wherein said plug element is rigidly connected to said opening region and is pivotally displaced together with said opening region to expose said opening.

14. The structure as defined in claim 4, wherein said opening region has a first end portion at which said opening region is connected to said plug member and an opposite second end portion, said second end portion being formed with a projection which engages the container wall by a friction-force connection and/or in a resilient mode after said plug member and said opening region have been slidably displaced relative to said opening.

15. The structure as defined in claim 5, wherein said opening further has two opposite rounded end surfaces respectively merging into said straight edges.

16. The structure as defined in claim 15, wherein said opening and said closing edge of the plug member each have a wedge-like configuration.

17. The structure as defined in claim 15, wherein said opening and said closing edge of the plug member each have an oval configuration.

18. The structure as defined in claim 5, wherein said container wall has an outer face which is formed with at least one projection at which said pressure edge of the plug element is arrested when the latter is at least partially slidably displaced relative to said opening.

19. The structure as defined in claim 18, wherein said plug member is made out of metal and is provided at its periphery with a reinforcing fold.

20. The structure as defined in claim 19, wherein said plug element is connected to said opening region by a rivet.

21. The structure as defined in claim 9, wherein said plug element is connected to said opening region by a rivet.

22. The structure as defined in 18, wherein said plug element is formed with a tab portion.

* * * * *